US006439519B1

(12) United States Patent
Takamasa

(10) Patent No.: US 6,439,519 B1
(45) Date of Patent: Aug. 27, 2002

(54) CASE ASSEMBLY INCLUDING LEGS AND CAPS

(75) Inventor: Araki Takamasa, Tokyo (JP)

(73) Assignee: Sony Computer Entertainment, Inc., Tokyo (JP)

( * ) Notice: Subject to any disclaimer, the term of this patent is extended or adjusted under 35 U.S.C. 154(b) by 0 days.

(21) Appl. No.: 09/611,285

(22) Filed: Jul. 6, 2000

(51) Int. Cl.[7] ..... A47B 91/00

(52) U.S. Cl. ..... 248/188.8; 248/615; 248/688

(58) Field of Search ..... 248/188.8, 188.9, 248/188.1–188.4, 188, 615, 634–635, 673, 677, 688; 16/32–33, 42 R, 42 T; 403/381, 408.1, 409.1, DIG. 11, DIG. 14; 220/288; 312/351.3, 351.4, 351.7–351.8; 411/41, 509, 372.5, 373, 337

(56) References Cited

U.S. PATENT DOCUMENTS 1,894,453 A * 1/1933 Sutton ..... 248/615
2,631,330 A * 3/1953 Becker ..... 16/30
2,935,280 A * 5/1960 Symonds ..... 248/615
3,401,908 A * 9/1968 Rapata ..... 248/188.8
3,640,496 A * 2/1972 Duncan ..... 248/188.9
3,665,800 A * 5/1972 Ryder ..... 85/5
4,243,194 A * 1/1981 Moore, Jr. et al. ..... 248/188.1
4,685,645 A * 8/1987 Cattaneo ..... 248/188.8
4,749,163 A * 6/1988 Mestdagh ..... 248/615
4,767,105 A * 8/1988 Caspers ..... 248/615
4,807,838 A * 2/1989 Anderson ..... 248/188.1
4,846,428 A * 7/1989 Johannes ..... 248/188.8
4,898,493 A * 2/1990 Blankenburg ..... 403/407.1
4,911,726 A * 3/1990 Warkentin ..... 411/424
4,923,158 A * 5/1990 Saisho ..... 248/188.8
5,017,068 A * 5/1991 Cooksey ..... 411/373
5,153,052 A * 10/1992 Tanaka et al. ..... 248/188.8
5,169,115 A * 12/1992 Chumg hsiang ..... 248/677
5,342,139 A * 8/1994 Hoffman ..... 403/405.1
5,653,417 A * 8/1997 DeBarber et al. ..... 248/688
5,697,586 A * 12/1997 Lybarger ..... 248/188.4
5,758,860 A * 6/1998 Hanazaki et al. ..... 248/634
5,771,990 A * 6/1998 Liang ..... 248/677
5,878,984 A * 3/1999 Grieser et al. ..... 248/188.8
5,921,516 A * 7/1999 Ho ..... 248/688
5,957,420 A * 9/1999 Wang ..... 248/188.8
6,048,147 A * 4/2000 Arisaka et al. ..... 411/48

* cited by examiner

*Primary Examiner*—Daniel P. Stodola
*Assistant Examiner*—Jennifer E. Novosad
(74) *Attorney, Agent, or Firm*—Katten Muchin Zavis Rosenman

(57) ABSTRACT

A case assembly with screw-covering members defined as legs and caps. The legs are adapted to be received in leg sockets arranged on the assembly, while the caps are adapted to be received in cap sockets arranged thereon. The legs, caps and their respective sockets are all configured so that only the legs fit into leg sockets and only the caps fit into cap sockets. The legs and caps are designed to appear aesthetically similarly, although their unique constructions prevent their misplacement with respect to the case assembly.

15 Claims, 5 Drawing Sheets

CASE ASSEMBLY INCLUDING LEGS AND CAPS

FIELD OF THE INVENTION

This invention relates to screw coverings in a case assembly in general, and more particularly to a system of coverings designated as legs and caps that each have a unique configuration to prevent improper placement of such coverings with respect to the case assembly.

BACKGROUND OF THE INVENTION

Case assemblies that form the structural components of larger systems are often fastened together with screws, bolts or the like. It is desirable to have a finished, seamless appearance, where such fasteners are for the most part hidden from view by removable covers or the like. However, it is also desirable to have the fasteners be easily accessible for routine maintenance or in the event that access to the interior of the assembly or system is necessary.

Case assemblies are also usually provided with functional features that allow for proper operation and placement in a variety of environments. For example, it is typical to provide vents and the like if electronic equipment is to be housed within. Similarly, case assemblies formed from metallic components or components having sharp edges are often provided with means to prevent damage to a surface upon which such assemblies rest, such as felt pads, rubber feet or other protective elements. While these functional features are often highly desirable from an operational viewpoint, they may also be situated in a particular fashion to enhance the aesthetic qualities or appearance of the system as a whole.

The case assembly of the present invention is provided with a system of screw-covering members that collectively serve a similar purpose, i.e., to hide screws or screw heads from view, while certain members also serve additional functions depending on their placement on the case assembly. The screw covering members of the present invention are divided into "caps," which are solely responsible for hiding screws or other fasteners from view, and "legs," which are further responsible for spacing the case assembly at a distance from a resting surface. The legs are also preferably manufactured from non-marring material so as to prevent the case assembly from damaging or scratching a surface upon which the assembly rests. A key feature of the present invention is that the system of caps and legs are dimensioned and configured to appear aesthetically similar, yet are not interengagable with their respective sockets arranged on the case assembly.

SUMMARY OF THE INVENTION

A case assembly is provided with a plurality of screw-covering members defining a plurality of legs and a plurality of caps. The legs are adapted to be received in a plurality of leg sockets arranged on said case assembly, while the caps are adapted to be received in a plurality of cap sockets also arranged on said assembly. The legs, caps and their respective sockets are all configured such that the leg sockets are adapted to prevent insertion of caps therein and the cap sockets are further adapted to prevent insertion of legs therein. The legs and caps are aesthetically similar in appearance and design, although their unique construction prevents their misplacement on the case assembly.

DETAILED DESCRIPTION OF THE PREFERRED EMBODIMENTS

Figure 1:
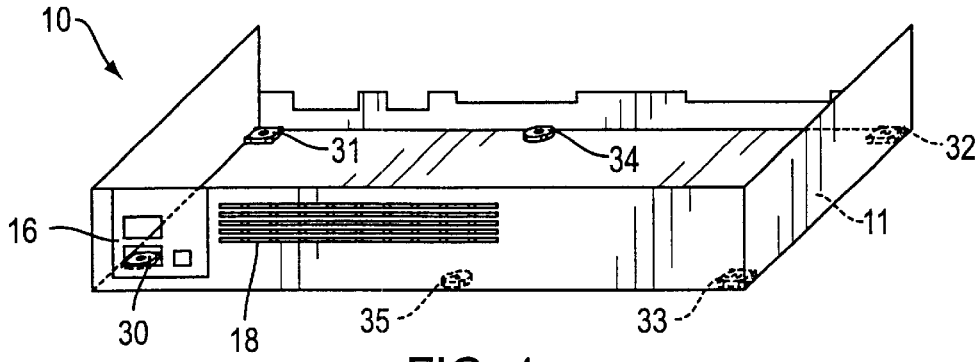
FIG. 1 is an isometric view of a representative case assembly of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
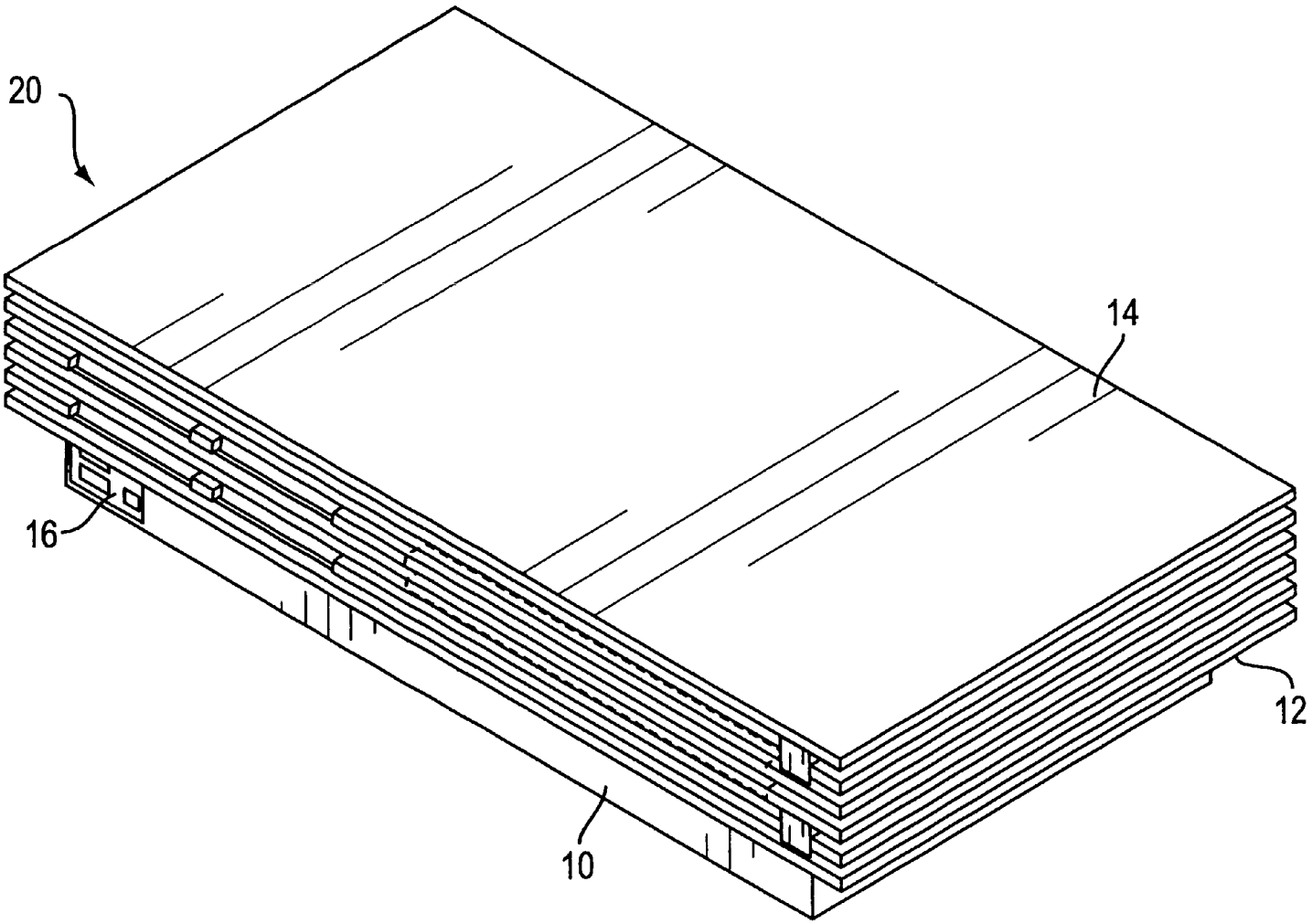
FIG. 2 is an isometric view of a representative system incorporating a case assembly of the present invention.

FIG. 1 is an isometric view of a representative case assembly 10 of the present invention, which comprises the bottom component of a larger system 20 (see FIG. 2) that will eventually be assembled into a commercial product, such as an entertainment system. Various electronics, motors, circuit boards and the like are usually housed in a central chassis 12, with an upper case 14 covering the chassis 12 as shown for example in FIG. 2. While the case assembly 10 of the invention will be demonstrated as a lower case with respect to a larger overall system, one skilled in the art will understand that such assembly 10 of the invention could also represent an upper case, as the situation may be. The case assembly 10 of the invention might also be provided with certain exterior features, such as provisions 16 for input/output devices, as well as a vent 18 or the like for exhausting heat generated by electrical components (not shown) housed within such assembly.

Figure 3:
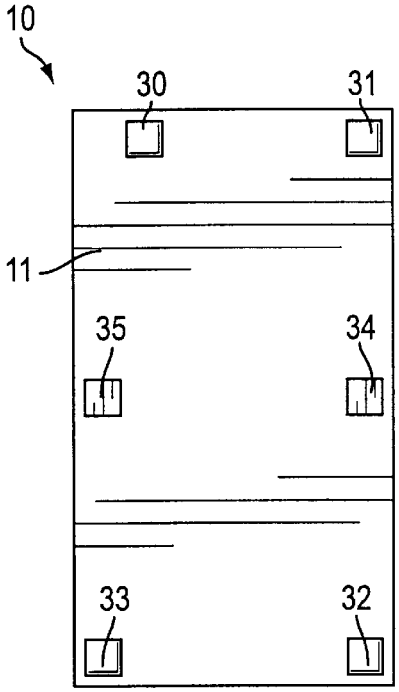
FIG. 3 is a bottom view of a case assembly of the invention.
Figure 4:
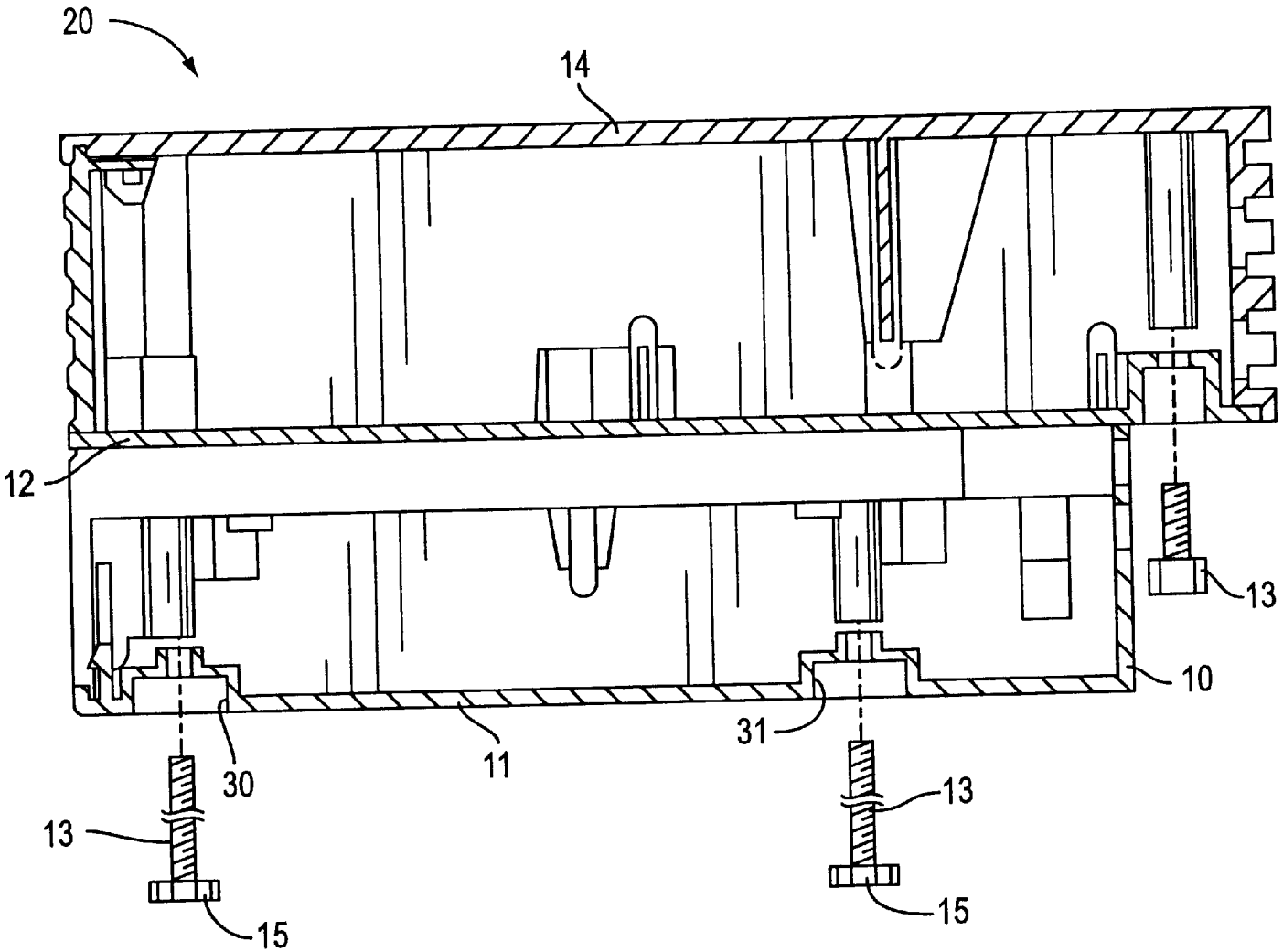
FIG. 4 is a cross sectional view of the system of FIG. 2 for purposes of illustration the use of fasteners for securing the system components together.

Other functional features, such as screw sockets 30–35 are normally provided on the bottom interior surface 11 of the case assembly 10 as shown in FIGS. 1, 3 and 4, for fastening the case assembly 10 to other components 12,14 of a system 20 (FIG. 4). For purposes of illustration, it will be assumed that threaded fasteners 13 (see FIG. 4) are used to secure the case assembly 10 to other components 12,14 of a system 20, although it will be understood that other types of fasteners may be used. As shown in FIG. 4, fasteners 13 will generally extend through the case assembly 10 and into the system body so that the fasteners 13 are substantially hidden within the system 20. The heads 15 of the fasteners or screws 13 are usually protected from access by covering members (which will be described in detail) so that the heads 15 are not exposed upon inspection of such case assembly 10, which might lead to inadvertent tampering with such fasteners or disassembly of the case assembly 10 from the system 20. Each screw covering member of the present invention will be defined as either a "leg" or a "cap," depending on its particular function and arrangement on the case assembly 10. Similarly, each socket 30–35 will be defined as either a leg socket or a cap socket, again depending on its particularly configuration and arrangement.

Figure 5:
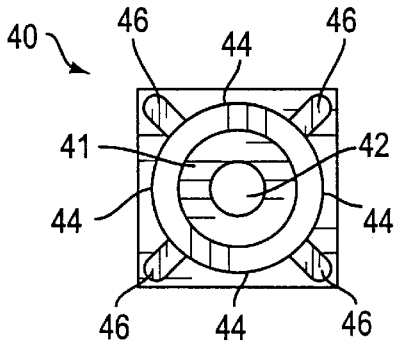
FIG. 5 is a top view of a leg socket of the invention.
Figure 6:
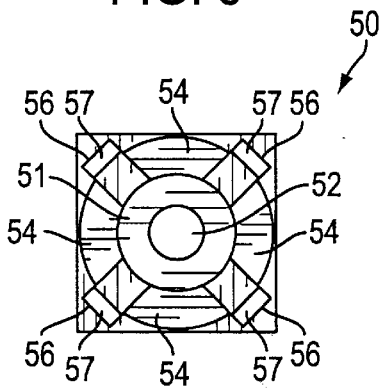
FIG. 6 is a top view of a cap socket of the invention.

FIG. 5 illustrates a top view of a leg socket 40 and FIG. 6 illustrates a top view of a cap socket 50. The legs sockets 40 preferably correspond to sockets 30–33 of the case assembly 10 (corner sockets of FIG. 3), while the cap sockets 50 preferably correspond to sockets 34–35 of the case assembly 10. The leg and cap sockets 40,50 are provided with orifices 42,52 for the passage of fasteners 13. Each leg and cap socket 40,50 has similar structural characteristics, such as arcuate portions 44,54 separated by corner portions 46,56, and circular portions 41,51 dimensioned to accommodate the fastener heads 15 (FIG. 4). Each socket is also preferably substantially square in design, and more preferably symmetric about the horizontal and vertical axes as shown.

Figure 7:
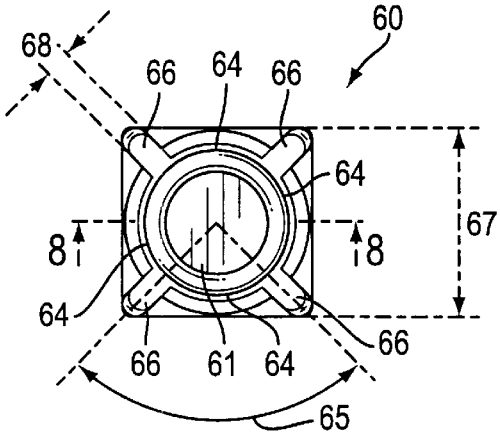
FIG. 7 is a top view of a leg of the invention.
Figure 8:
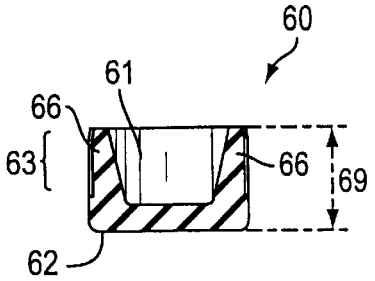
FIG. 8 is a section taken through 8—8 of FIG. 7.

FIG. 7 is a top view and FIG. 8 is a section taken through 8—8 of FIG. 7 of a leg screw covering member 60 having a head portion 62 and an engagement portion 63. The engagement portion 63 is further defined by a plurality of arcuate portions 64 and a plurality of insertion portions 66 arranged symmetrically about a cylindrical recess 61, said recess 61 dimensioned to accommodate a fastener head 15 that would be seated within a leg socket 40. Reference numeral 65 designates the angular displacement between a pair of insertion portions 66, which is preferably equal to a value of ninety degrees. Reference number 67 designates the diameter of a circle circumscribed about the arcuate portions 64, or the diametrical distance between opposing arcuate portions 64 on the leg 60. Reference number 69 (FIG. 8) designates the total height of the leg 60 or the height of the head portion 62 plus the height of the engagement portion 63. The corner portions 46 of the leg socket 40 (FIG. 5) are dimensioned to slidably receive the insertion portions 66 of the legs 60, while the arcuate portions 44 of the leg socket 40 are dimensioned to slidably accommodate the arcuate portions 64 of the legs 60. The legs 40 are preferably formed from a non-marring material, such as rubber or the like, and are preferably dimensioned for press fit engagement with the leg sockets 40. They are also dimensioned to extend beyond the bottom surface 11 of the case assembly 10 (see FIG. 15) so as to space the case assembly 10 from any surface upon which it rests. In other words, the height 69 of a leg is preferably greater than the depth of a leg socket 40.

Figure 9:
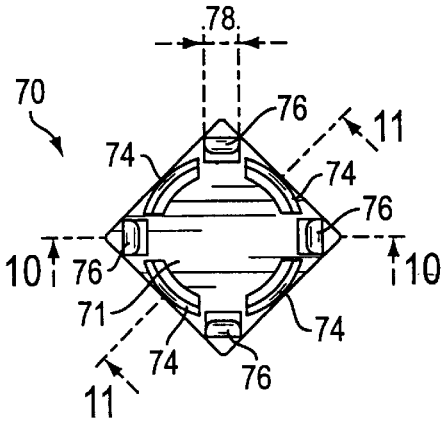
FIG. 9 is a top view of a cap of the invention.
Figure 10:
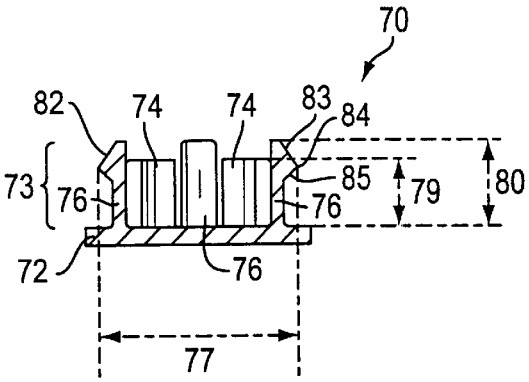
FIG. 10 is a section taken through 10—10 of FIG. 9.
Figure 11:
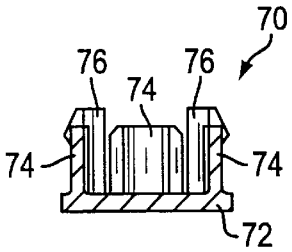
FIG. 11 is a section taken through 11—11 of FIG. 9.
Figure 12:
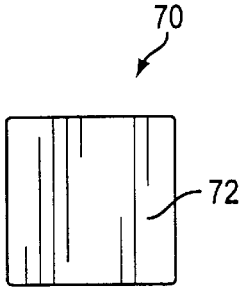
FIG. 12 is a bottom view of a cap of the invention.

FIG. 9 is a top view, FIG. 10 is a section taken through 10—10 of FIG. 9, FIG. 11 is a section taken through 11—11 of FIG. 9 and FIG. 12 is a bottom view of a cap covering member 70 having a head portion 72 and an engagement portion 73. The engagement portion 73 is further defined by a plurality of arcuate portions 74 and a plurality of insertion portions 76 arranged symmetrically about a cylindrical recess 71, said recess 71 dimensioned to accommodate a fastener head 15 that would be seated within a cap socket 50. Reference number 77 (FIG. 10) designates the diameter of a circle circumscribed about the arcuate portions 74, or the diametrical distance between opposing arcuate portions 74 on the cap 70. Reference number 79 (FIG. 10) designates the height of an arcuate portion 74 while reference number 80 (FIG. 10) designates the height of an insertion portion 76 of the cap 70, with the height 80 of the insertion portions 76 being preferably greater than the height 79 of the arcuate portions as shown. Similar to the insertion portions 66 of a leg 60, the insertion portions 76 of a cap 70 are preferably arranged at right angles with respect to each other, with such angular displacements determined mostly by the socket configurations.

The arcuate portions 74 and the insertion portions 76 are preferably discontinuously arranged around the cap 70, as compared with the arcuate portions 64 and insertion portions 66 of the leg 60 which are preferably arranged continuously thereabout. The discontinuity present in the engagement portion 73 of the cap 70 allows certain portions of the cap 70 to move upon engagement and disengagement with the case assembly 10 and cap socket 50. The insertion portions 76 of the cap 70 are preferably provided with snap lock elements 82 disposed at their ends that are adapted to engage slots or orifices 57 (see FIGS. 6 and 14) in a cap socket. To achieve a snap lock engagement with each slot 57, the insertion portion 76 is preferably resiliently attached to the head portion 72, and is further provided with camming surfaces 83 and 85 on said snap lock element 82 for respective engagement and disengagement of the insertion portion 76 with the slot 57. In other words, movement of camming surface 83 against the edge of the slot 57 causes the insertion portion 76 to deflect toward the center of the cap 70 until the ridge or crest 84 between the camming surfaces 83 and 85 passes into the slot 57, which results in the snap engagement of the insertion portion 76 with the slot 57. The second camming surface 85 provides a similar inward displacement upon disengagement of the insertion portions 76 with the slots 57. Thus, each cap 70 is adapted for removable, snap lock engagement with a cap socket 50.

Figure 14:
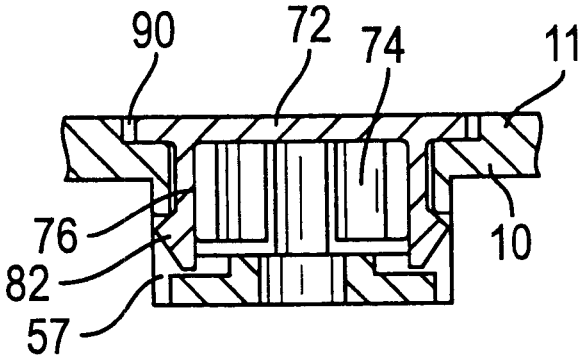
FIG. 14 is a cross sectional view of a cap socket with a cap inserted therein.

The height 80 of each cap 70 is preferably equal to the height of the cap socket 50, so that the head portion 72 of the cap socket 70 is preferably flush with the bottom surface 11 of the case assembly 10 when engaged therewith as shown in FIG. 14. In this regard, it is preferable to have at least the head portion 72 of a cap 70, and more preferably the outer, exposed surface of the head portion 72, be formed from the same material as the bottom surface 11 of the case assembly 10, so that the caps 70 blend into the environment of the case assembly 10. The caps 70 serve a similar purpose as the legs 60 in that they serve as screw covering members. However, it is not necessary that all screw covering members serve the additional function of the legs 60, such as maintaining the case assembly 10 at a distance from a resting surface and protecting such resting surface from damage caused by sharp edges or the like inherent in the construction of a case assembly 10. In fact, for flat placement it would be desirable if only the corners of the assembly were raised with legs, otherwise if the middle was also raised there would be a problem if the middle legs were not identical with the corner legs, i.e., there would be wobbling and the like.

The leg and cap sockets 40 and 50 respectively, as well as the legs and caps 60 and 70 respectively, are all to a certain extent visually similar. For example, the head portions 62 and 72 of the legs and caps respectively are preferably square (FIG. 12) and comprise the same area dimension, while the height of the leg 69 and the height of the cap 80 also appear to be dimensionally similar. Yet each are provided with structural features that safeguard the proper placement of a leg 60 only within a leg socket 40 and a cap 70 only within a cap socket 50. Such structural features also prevent improper placement of a leg 60 within a cap socket 50 and a cap 70 within a leg socket 40. For example, the radial distance between the center of a leg 60 and the insertions portions 66 is greater than the radial distance between the center of a cap 70 and the insertion portions 76. Therefore, the insertion portions 66 of the leg 60 would not fit into the corner portions 56 of a cap socket 50. Similarly, the thickness 78 (FIG. 9) of the insertion portion 76 of a cap 70 is greater than the thickness 68 (FIG. 7) of the insertion portions 66 of the legs 60. Therefore, the insertion portion 76 of a cap 70 would not fit into the corner portion 46 of a leg socket 40.

Figure 13:
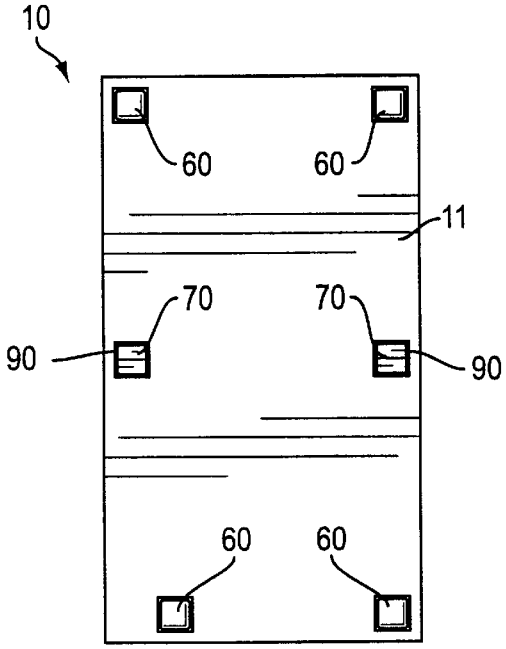
FIG. 13 is a bottom view of a case assembly of the invention with legs and caps arranged thereon.
Figure 15:
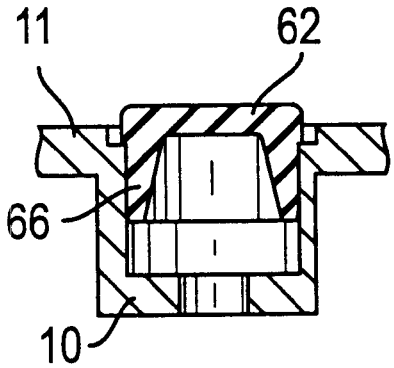
FIG. 15 is a cross sectional view of a leg socket with a leg inserted therein.

FIG. 13 is a view of the bottom surface 11 of the case assembly 10 with legs 60 and caps 70 arranged thereon. FIG. 14 is a cross sectional view of a cap socket with a cap received therein, while FIG. 15 is a cross sectional view of a leg socket with a leg received therein. The caps 70, preferably being formed from the same material as the bottom surface 11 of the case assembly 10, tend to blend into the case assembly 10, while the legs 60 are preferably formed from a non-marring material that is different from the bottom surface 11 preferably protrude outwardly from the bottom surface 11 as shown in FIG. 15 to space the case assembly 10 a certain distance from a resting surface. Each leg 60 and cap 70 is removably engageable with the case assembly 10. In order to remove the leg 60 from the case assembly 10, which is initially slidably engaged within a leg socket 40, one merely has to use one's fingernail (not shown) or an appropriate tool (not shown) to pull on the portion of the leg 60 that protrudes from the bottom surface 11 of the case assembly to slide such leg 60 out from a leg socket 40. With respect to a cap 70, which is preferably snap lock engaged with a cap socket 50, an access channel 90 (FIGS. 13 and 14) is provided for access by one's fingernail (not shown) or an appropriate tool (not shown), which channel 90 is essentially the difference between the size of the head portion 72 of the cap 70 and the size of the cap socket 50 into which such cap 70 is received, the latter obviously being slightly larger on all sides than the former.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. For example, while a certain number of legs and caps are shown on a case assembly, it will be understood that other variations and arrangements of legs and caps will be operable. Also, while the legs and caps have certain structural features that allow for proper engagement with their respective socket portions, such legs and caps may have different structural designs, so long as the legs only fit within leg sockets and the caps only fit within cap sockets.

I claim:

1. A system of legs and caps for removable position in leg sockets and cap sockets in a case assembly, each of said legs and said caps comprising:

(a) a head member having a front surface and a back surface, (b) a plurality of arcuate sections disposed around said back surface of said head member, (c) a plurality of engagement members disposed around said back surface of said head member, wherein said engagement members of said respective legs and caps are shaped and dimensional differently from one another to prevent the positioning of said legs in cap sockets and said caps in leg sockets in the case assembly.

2. A system in accordance with claim 1, wherein said arcuate sections of said caps further comprise a first height dimension and said arcuate sections of said legs further comprise a second height dimension, said first and second height dimensions of said arcuate sections being different.

3. A system in accordance with claim 2, wherein said second height dimension is greater than said first height dimension.

4. A system in accordance with claim 1, wherein said engagement members of said caps further comprise a first height dimension and said engagement members of said legs further comprise a second height dimension, said first and second height dimensions of said engagement members being substantially the same.

5. A system in accordance with claim 1, wherein said engagement members are dimensioned and arranged on said legs and caps such that a circle circumscribed about said engagement members of said legs has a larger diameter than a circle circumscribed about said engagement members of said caps.

6. A system in accordance with claim 1, wherein said engagement members of said caps are further provided with snap lock elements adapted for snap lock engagement with a case assembly.

7. A system in accordance with claim 1, wherein said engagement members of said legs are further adapted for press fit engagement with a case assembly.

8. A case assembly having a bottom surface, comprising:

(a) a plurality of screw-covering members defining a plurality of legs and a plurality of caps;

(b) a plurality of leg sockets adapted to receive said plurality of legs; and (c) a plurality of cap sockets adapted to receive said plurality of caps, wherein said plurality of leg sockets are configured differently from said plurality of cap sockets;

wherein each of said plurality of legs further comprises a head portion and an engagement portion and each of said plurality of caps further comprises a head portion and an engagement portion;

wherein said engagement portions of each of said legs and said caps is symmetric about a central axis and further comprise a plurality of arcuate portions disposed between a plurality of insertion portions.

9. A case assembly in accordance with claim 8, wherein said plurality of arcuate portions of said cap engagement portions further comprise a first height dimension and said plurality of arcuate portions of said leg engagement portions further comprise a second height dimension, said first and second height dimensions of said arcuate portions being different.

10. A case assembly in accordance with claim 8, wherein said plurality of insertion portions of said cap engagement portions further comprise a first height dimension and said plurality of insertion portions of said leg engagement portions further comprise a second height dimension, said first and second height dimensions of said insertion portions being substantially the same.

11. A case assemble in accordance with claim 8, wherein said insertion portions of each of said plurality of caps further comprise snap lock elements for snap lock engagement with said plurality of cap sockets.

12. A case assembly in accordance with claim 11, wherein said insertion portions of each of said plurality of legs further comprise ribs for press fit engagement with said plurality of leg sockets.

13. A case assembly in accordance with claim 8, wherein said insertion portions of each of said plurality of legs and caps are spaced apart at right angles.

14. A case assembly in accordance with claim 13, wherein said insertion portions are dimensioned and arranged on said legs and caps such that a circle circumscribed about said insertion portions of said legs has a larger diameter than a circle circumscribed about said insertion portions of said caps.

15. A case assembly in accordance with claim 14, wherein said head portions of said legs and caps are square.

* * * * *